United States Patent [19]

Matsui

[11] Patent Number: 4,484,042

[45] Date of Patent: Nov. 20, 1984

[54] SNAP ACTION PUSH BUTTON SWITCH

[75] Inventor: Yasuo Matsui, Iwaki, Japan

[73] Assignee: Alps Electric Co., Ltd., Tokyo, Japan

[21] Appl. No.: 519,684

[22] Filed: Aug. 2, 1983

[30] Foreign Application Priority Data

Aug. 3, 1982 [JP] Japan ..... 57-117355[U]

[51] Int. Cl.[3] ..... H01H 5/04

[52] U.S. Cl. ..... 200/67 DB; 200/275; 200/159 B; 200/5 A; 200/243

[58] Field of Search ..... 200/5 A, 67 D, 67 DA, 200/67 DB, 159 A, 159 B, 275, 243

[56] References Cited

U.S. PATENT DOCUMENTS

| | | | |
|---|---|---|---|
| 3,306,998 | 2/1967 | Russell | 200/67 DB |
| 3,917,917 | 11/1975 | Murata | 200/5 A |
| 3,996,429 | 12/1976 | Chu et al. | 200/67 DB |
| 4,146,767 | 3/1979 | Murata | 200/159 B |
| 4,385,218 | 5/1983 | Nishida | 200/159 B |
| 4,400,596 | 8/1983 | Fukukura et al. | 200/5 A |
| 4,412,113 | 10/1983 | Mitsugi et al. | 200/67 DB |

*Primary Examiner*—Stephen Marcus
*Assistant Examiner*—Ernest G. Cusick
*Attorney, Agent, or Firm*—Guy W. Shoup; Gerard F. Dunne

[57] ABSTRACT

A push-button switch affording a clear click feeling, comprising a contact plate which is curved in one direction and which is formed into a movable contact by providing therein two substantially parallel slits extending in a perimetric direction, forming a movable contact portion between said two slits, and curving both side edges of said contact plate along said slits oppositely to the direction of the curvature of said movable contact portion so as to form normally-contacted contact portion; a switch body which includes first stationary contacts and a second stationary contact; and a push button; said normally-contacted contact portions of said contact plate being normally held in electrical contact with said first stationary contacts of said switch body, while said movable contact portion of said contact plate is depressed and deformed oppositely to the direction of the curvature thereof by said push button, thereby to come into electrical contact with said second stationary contact of said switch body; said contact plate including both-end joint portions which join said movable contact portion and said normally-contacted contact portions integrally, a pair of bent line portions being formed between said each joint portion and said normally-contacted contact portions, said each bent line portion defining an acute angle with respect to the slit.

6 Claims, 6 Drawing Figures

SNAP ACTION PUSH BUTTON SWITCH

BACKGROUND OF THE INVENTION

The present invention relates to a small-sized push-button switch for use in a radio receiver, a cassette tape recorder, a video tape recorder, a television receiver, etc.

When, in such push-button switch, a push button is depressed and displaced to depress and deform a movable contact portion oppositely to the direction of curvature thereof, both the end parts of a movable contact plate extending in a perimetric direction thereof are bent oppositely to the direction of curvature of the end parts and give rise to a click feeling in a position where the movable contact portion comes into contact with a stationary contact plate. Since the click feeling serves to clarify the ON-OFF operation of the switch, it is desired to be clear. In order to attain a reliable switching operation, the operating force of the movable contact portion needs to be great to a certain degree, and this movable contact portion must not move laterally when depressed.

SUMMARY OF THE INVENTION

It is therefore an object of the present invention to provide a small-sized push-button switch in which the operating force of a movable contact portion is great, a clear click feeling is generated, and when depressed, the movable contact portion does not move laterally.

In order to accomplish the object, a push-button switch according to the present invention comprises a contact plate which is curved in one direction and which is formed into a movable contact by providing therein two substantially parallel slits extending in a perimetric direction, forming a movable contact portion between said two slits, and curving both side edges of said contact plate along said slits oppositely to the direction of the curvature of said movable contact portion so as to form normally-contacted contact portions; a switch body which includes first stationary contacts and a second stationary contact; and a push button; said normally-contacted contact portions of said contact plate being normally held in electrical contact with said first stationary contacts of said switch body, while said movable contact portion of said contact plate is depressed and deformed oppositely to the direction of the curvature thereof by said push button, whereby said movable contact portion comes into electrical contact with said second stationary contact of said switch body; said contact plate including both-end joint portions which join said movable contact portion and said normally-contacted contact portions integrally, bent line portions being formed between said joint portions and said normally-contacted contact portions so as to be inclined to said slits.

In an aspect of performance of the present invention, the acute angle of the bent line portion to the slit is substantially 45°.

In another aspect of performance, the first and second stationary contacts are insert-molded in the switch body in such a manner that the second stationary contact is located between the pair of first stationary contacts.

Further objects and features of the present invention will become apparent from the following description taken in conjunction with the drawings.

PREFERRED EMBODIMENT OF THE INVENTION

Now, the present invention will be described with reference to the drawings.

Figure 1:
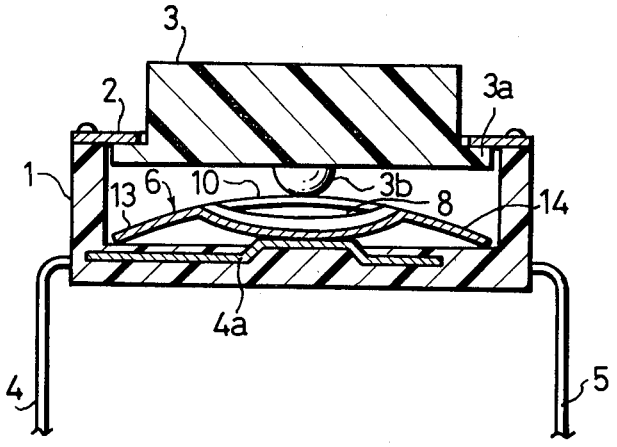
FIG. 1 is a sectional view of a push-button switch showing an embodiment of the present invention.
Figure 2:
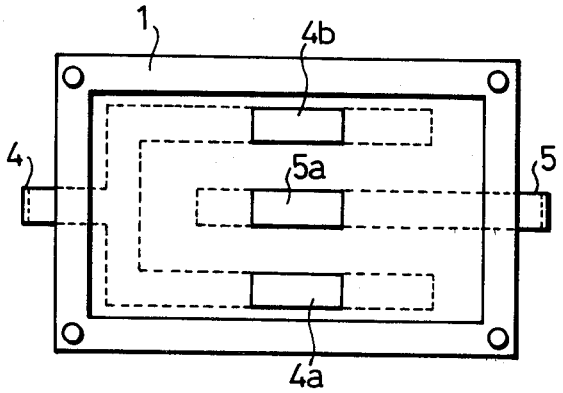
FIG. 2 is a plan view of a switch body in FIG. 1.

In FIG. 1, the opening of a box-shaped switch body 1 is closed with a cover 2. Numeral 3 designates a push button. This push button 3 penetrates the cover 2 to partly project upwards, and is checked from falling out by means of a flange 3*a* thereof. First and second fixed terminals 4 and 5 are insert-molded in the bottom part of the switch body 1. As shown in FIG. 2, the fixed terminal 4 has first stationary contacts 4*a* and 4*b* which are bifurcated and which are arranged on both the sides of the bottom part of the switch body 1. A second stationary contact 5*a*, which is integral with the fixed terminal 5, is arranged in the middle between the stationary contacts 4*a* and 4*b*.

Figure 3:
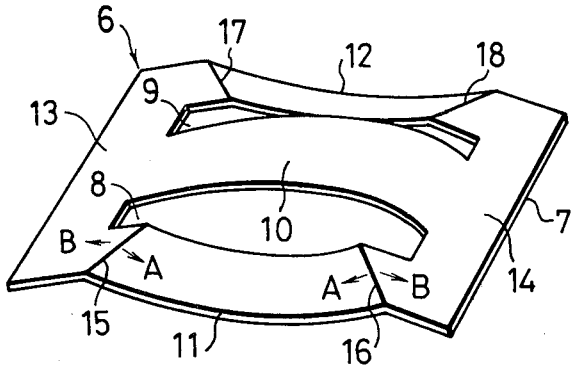
FIG. 3 is a perspective view of a movable contact in FIG. 1.
Figure 4:
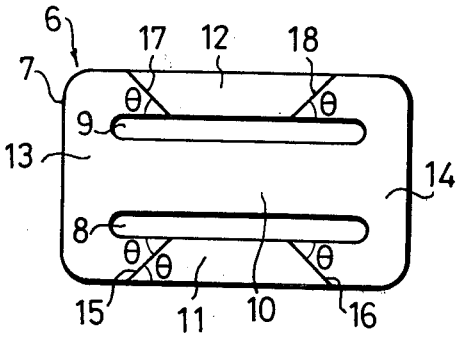
FIG. 4 is a plan view corresponding to FIG. 3.
Figure 5:
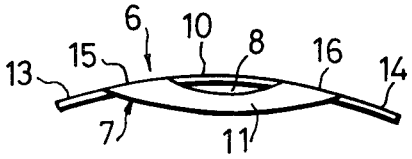
FIG. 5 is a front view corresponding to FIG. 4.
Figure 6:
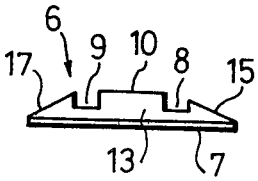
FIG. 6 is a side view corresponding to FIG. 4.

Numeral 6 designates a movable contact which is disposed between the bottom part of the switch body 1 and the push button 3. This movable contact 6 is formed by molding a contact plate 7, which is curved in one direction (refer to FIGS. 1 to 6). As best shown in FIGS. 3 and 4, the contact plate 7 is formed with two slits 8 and 9 which extend in a perimetric direction and between which a movable contact portion 10 is formed. The movable contact portion 10 abuts against the spherical bulge 3*b* of the push button 3 so as to urge the push button 3 outwards, and the lower surface side thereof faces the second stationary contact 5*a*.

In both the side edges of the contact plate 7 along the slits 8 and 9, there are formed normally-contacted contact portions 11 and 12 which are curved in the direction opposite to that of the movable contact portion 10 as clearly seen from FIG. 3. The normally-contacted contact portions 11 and 12 are normally held in contact with the stationary contacts 4*a* and 4*b*, respectively. Numerals 13 and 14 indicate joint portions which join the movable contact portion 10 and the normally-contacted contact portions 11, 12 integrally in both the end parts of the contact plate 7 extending in a perimetric direction. At the boundaries between the joint portions 13, 14 and the normally-contacted portions 11, 12 there are formed bent line portions 15, 16, 17 and 18 which demarcate them. The inclination angles $\theta$ of the bent line portions 15, 16, 17 and 18 with respect to the slits 8 and 9 are rendered substantially 45°. Thus, the bent line portions 15 and 16, and 17 and 18 intersect substantially orthogonally.

In the next place, the operation of the push-button switch having such construction will be described.

The push button 3 is depressed and displaced downwards as viewed in FIG. 1, to depress and deform the movable contact portion 10 oppositely to the direction of the curvature thereof. Then, the movable contact portion 10 abuts on the stationary contact 5*a*. In this case, the movable contact portion 10 tends to stretch in the longitudinal direction thereof. Since, however, compressive stresses A (refer to FIG. 3) act on the normally-contacted contact portions 11 and 12, the movable contact portion 10 cannot stretch up and flexes in a corrugated form. Thus, a click sound is generated, and also a proper operating force is obtained. Further, the intense compressive stresses A in this case push the normally-contacted contact portions 11 and 12 tightly and check the lateral movements thereof reliably.

Of course, the inclination angle $\theta$ need not be always set at 45°, but it may be a value above or below 45°.

The inclination angle $\theta=45°$ is ideal, for the following reason:

When the movable contact portion 10 is depressed and deformed oppositely to the direction of the curvature thereof by the push button 3, it is forcibly stretched, and tensile stresses B (refer to FIG. 3) act on the joint portions 13 and 14 at both the ends of the contact plate 7. On the other hand, the compressive stresses A act on the normally-contacted contact portions 11 and 12.

When the compressive stresses A counteracting the tensile stresses B are small, unfavorably they form the causes of the following drawbacks at the depression and deformation of the movable contact portion 10:

1. The click feeling does not develop, or develops very little.

2. The operating force of the movable contact portion 10 is small.

3. It is feared that the whole contact plate will move laterally to establish an unstable electrical contact state.

It is accordingly understood that the compressive stresses A may be rendered great.

It has been found that the compressive stress A becomes the maximum when the inclination angle $\theta$ is 45°, that the former decreases as the latter becomes greater, and that the former becomes the minimum when the latter is 90°. As a result, the inclination angle $\theta$ of 45° is the optimum.

As set forth above, the present invention consists in a push-button switch comprising a contact plate which is curved in one direction and which is formed into a movable contact by providing therein two substantially parallel slits extending in a perimetric direction, forming a movable contact portion between said two slits, and curving both side edges of said contact plate along said slits oppositely to the direction of the curvature of said movable contact portion so as to form normally-contacted contact portions; a switch body which includes first stationary contacts and a second stationary contact; and a push button; said normally-contacted contact portions of said contact plate being normally held in electrical contact with said first stationary contacts of said switch body, while said movable contact portion of said contact plate is depressed and deformed oppositely to the direction of the curvature thereof by said push button, thereby to come into electrical contact with said second stationary contact of said switch body; said contact plate including both-end joint portions which join said movable contact portion and said normally-contacted contact portions integrally, bent line portions being formed between said joint portions and said normally-contacted contact portions so as to be inclined to said slits. With the push-button switch, the operating force of the movable contact portion is great, the click feeling is clear, and the movable contact portion can be prevented from moving laterally when depressed.

What is claimed is:

1. A push-button switch comprising a contact plate which is curved in one direction and which is formed into a movable contact by providing therein two substantially parallel slits extending in a perimetric direction, forming a movable contact portion between said two slits, and curving both side edges of said contact plate along said slits oppositely to the direction of the curvature of said movable contact portion so as to form normally-contacted contact portions; a switch body which includes first stationary contacts and a second stationary contact; and a push button; said normally-contacted contact portions of said contact plate being normally held in electrical contact with said first stationary contacts of said switch body, while said movable contact portion of said contact plate is depressed and deformed oppositely to the direction of the curvature thereof by said push button, thereby to come into electrical contact with said second stationary contact of said switch body; said contact plate including both-end joint portions which join said movable contact portion and said normally-contacted contact portions integrally, a pair of bent line portions being formed between said each joint portion and said normally-contacted contact portions, said bent line portions being inclined to said slits.

2. A push-button switch according to claim 1, wherein an acute angle of said each bent line portion defined with respect to the slit is substantially 45°.

3. A push-button switch according to claim 1, wherein said pair of bent line portions are formed so as to substantially intersect orthogonally.

4. A push-button switch according to claim 1, wherein an acute angle of said each bent line portion defined with respect to the slit is substantially 45°, and said pair of bent line portions are formed so as to substantially intersect orthogonally.

5. A push-button switch according to claim 1, wherein said second stationary contact is arranged between a pair of first stationary contacts, and all these stationary contacts are insert-molded in said switch body.

6. A push-button switch according to claim 1, wherein said push button is placed on said contact plate with a spherical bulge of the former located on said movable contact portion of the latter.

* * * * *